United States Patent [19]

Hazard

[11] 4,124,151

[45] Nov. 7, 1978

[54] TOGGLE TYPE DISPENSING CLOSURE

[75] Inventor: Robert E. Hazard, N. Kingstown, R.I.

[73] Assignee: Polytop Corporation, Slatersville, R.I.

[21] Appl. No.: 743,922

[22] Filed: Nov. 22, 1976

[51] Int. Cl.[2] ..... B65D 43/24

[52] U.S. Cl. ..... 222/498; 222/517; 222/543; 222/556; 220/335; 220/339

[58] Field of Search ..... 222/498, 517, 543, 556; 220/335, 339

[56] References Cited

U.S. PATENT DOCUMENTS

| | | | |
|---|---|---|---|
| 2,263,783 | 11/1941 | Langenstein | 222/498 X |
| 2,638,253 | 5/1953 | Mueller | 222/498 X |
| 2,708,535 | 5/1955 | Dettelbach | 222/498 |
| 3,289,877 | 12/1966 | Wolf | 220/339 |
| 3,362,591 | 1/1968 | Latham et al. | 222/498 |
| 3,741,447 | 6/1973 | Mices et al. | 222/517 |

FOREIGN PATENT DOCUMENTS

| | | | |
|---|---|---|---|
| 1,056,999 | 2/1967 | United Kingdom | 220/339 |

*Primary Examiner*—Robert B. Reeves

*Assistant Examiner*—Frederick R. Handren

*Attorney, Agent, or Firm*—Edward D. O'Brian

[57] ABSTRACT

A "toggle" type dispensing closure can be constructed so as to utilize a first closure part such as a cap or the top of a container upon which there is pivotally mounted a second closure part such as a lid so that the second closure part may be pivoted between a closed position in which an opening through the first part is closed off and an open position in which material may be moved through the opening. With such a closure one end of a spring is pivotally connected to the first closure part and the other end of the spring is pivotally connected to the other closure part. The spring is connected to these two parts at spaced locations such that the distance between the ends of the spring is decreased as the second closure part is moved between these positions. Preferably, the entire dispensing closure is formed as an integral unit of a somewhat flexible, somewhat resilient polymer material in such a manner that the first part is mounted on the second by means of trunnions and bearings which are snapped together and in such a manner that the ends of the spring are connected to the parts by integral, flexible sections of the polymer material serving to pivotally connect the spring to these parts.

7 Claims, 6 Drawing Figures

TOGGLE TYPE DISPENSING CLOSURE

CROSS-REFERENCE TO RELATED APPLICATIONS

This specification relates to subject matter as set forth in the co-pending U.S. patent application Ser. No. 665,728 filed Mar. 11, 1976, by Woodrow S. Wilson and Robert E. Hazard entitled "TAMPER-EVIDENT, ONE-PIECE DISPENSING CLOSURES", now U.S. Pat. No. 4,081,108. The entire disclosure of this co-pending application is incorporated herein by reference.

BACKGROUND OF THE INVENTION

The invention set forth herein pertains to new and improved "toggle" type dispensing closures.

Increasingly the term "dispensing closure" has been utilized to designate closures which are adapted to be more or less permanently attached to or formed integrally with a container and which utilize a movable member which is adapted to be moved between an open position in which an opening through the closure is opened and a closed position in which the opening is closed off. This term "dispensing closure" is probably most commonly utilized in connection with closures which are adapted to be mounted upon bottles or similar containers and which utilize a spout which is adapted to be located between a closed position and an open position in which a spout is in alignment with the opening through the closure.

However, this term is also employed commonly to designate closures in which a lid is rotatably mounted so as to be capable of being moved between open and closed positions as noted. Both of these types of closures are considered to have significant commercial and utilitarian merit. At present they are most commonly formed out of a polyolefin such as a common grade of either low or high density polyethylene or polypropylene by conventional injection mold techniques. Such closures normally require assembly after their parts are manufactured by such techniques.

It is known to facilitate the assembly of a dispensing closure by forming the parts of such a closure so that they are integrally connected together either by a flexible strip or hinge-like section. Such a strap or such a hinge-like section movably or pivotally connects the parts of such a closure together in such a manner that such parts cannot be lost from one another. When such a strap or such a section is appropriately designed it can serve more or less as a guide or alignment structure to facilitate the closure parts being brought together into a final operative assembly. This is considered to be desirable from the point of view of obtaining economy of manufacture.

As the dispensing closure field has developed it has been realized that one-piece dispensing closures employing closure parts connected by a strap or hinge-like structure could be modified so as to utilize what may be referred to as a "toggle" type action. This term "toggle" is a hard to define mechanical term referring to the utilization of a first force to bias a member in either of two different positions in such a manner that a further force is required to move the member between these two positions. Frequently the first force is derived from a spring or spring means and the second force is applied so as to elongate the spring as the member is moved between such positons.

The toggle actions which have been incorporated in known one-piece dispensing closures are primarily based upon the use of a part integrally formed with such a closure as a tension member or spring which will exercise a pull so as to hold the principal parts of such a closure in either a closed or open position. Thus, for example, prior dispensing closures employing what may be referred to as a "toggle" action have utilized between a cap adapted to be attached to a container and a lid pivotally mounted upon the cap, one or more spring-like sections of polymer material extending between the cap and the lid in such a manner as to tend to hold the lid in either an open or a closed position and in such a manner that the spring-like sections have to be stretched or placed in tension to move the lid between these two positions.

Unquestionably dispensing closure structures as are indicated employing a toggle action are utilitarian. They are considered to be relatively undesirable from a commercial standpoint because of the manner in which they are constructed. In order to obtain satisfactory operational characteristics in such a closure which is relatively simple (and inexpensive) to mold by injection molding techniques it has been necessary to employ a toggle or spring member in such a manner that such a member tends to project exteriorly of a one-piece closure when the closure itself is in either an open or closed configuration, or when the closure lid is in both of these positions. It is undesirable for commercial reasons to utilize any dispensing closure which has any parts which significantly extend from the closure when the closure is closed.

This is because such extending parts are apt to become damaged during handling and/or capping operations. It is considered relatively impractical and/or difficult to mount dispensing closures having projecting parts on containers using much common capping equipment. Further, it is undesirable to have parts such as a toggle member or spring extending from the exterior of a closure when the closure is in use and is in an open position. Such extending parts tend to present an undesirable appearance. Whenever such parts extend from the closure—even when the closure is open—there is danger of such parts becoming damaged and/or interfering to a minor extent with the use of the closure.

BRIEF SUMMARY OF THE INVENTION

A broad object of the present invention is to provide new and improved "toggle" type dispensing closures. More specifically the invention is intended to supply dispensing closures of the type indicated which overcome various limitations and disadvantages of prior closures as are indicated in the preceding discussion. A further object of the present invention is to provide dispensing closures as indicated which can be constructed in such a manner that no parts of such closures significantly extend from the exteriors of such closures when such closures are in either open or closed positions. Further objectives of the present invention are to provide dispensing closures as indicated which can be easily and conveniently manufactured with minimal difficulty using conventional injection molding techniques, which may be easily and conveniently assembled to an operative configuration without significant difficulty or expense, which may be easily and conveniently utilized over a prolonged period and which operate satisfactorily throughout such utilization.

In accordance with this invention these various objectives are achieved in the combination of a dispensing closure having a first closure part having an opening extending therethrough, a second closure part pivotally mounted on the first closure part so as to be capable of being rotated between a closed position in which said second closure part closes off the opening so that material cannot pass therethrough and an open position in which said opening is exposed so as to permit material to pass therethrough and spring means connecting said first and second closure parts for holding said second closure part in either of said positions in which the improvement comprises: said spring means comprising a spring having ends, one of which ends is pivotally attached to the first closure part and the other of which ends is pivotally connected to the second closure part, said spring being connected to said first and said second closure parts at spaced locations such that the distance between said ends and said spring is decreased so as to compress said spring as said second closure part is moved between said positions.

BRIEF DESCRIPTION OF THE DRAWING

Although a summary such as the preceding indicates much information with respect to the nature of a structure coming within the scope of an invention because of its length such a summary cannot effectively delineate many important aspects or features of an invention. Because of this, "toggle" type dispensing closures coming within the scope of the present invention are best more fully indicated with reference to the accompanying drawing in which.

Figure 1:
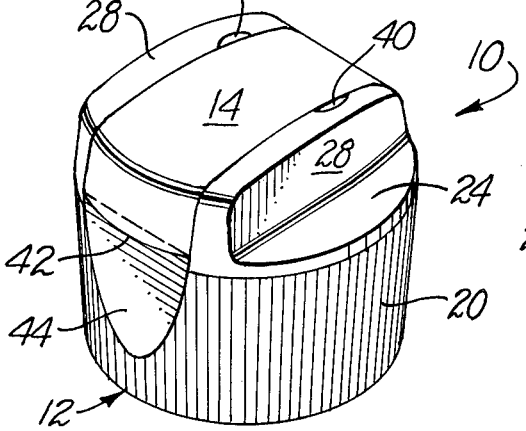
FIG. 1 is an isometric view of a presently preferred embodiment or form of a dispensing closure in accordance with this invention.
Figure 2:
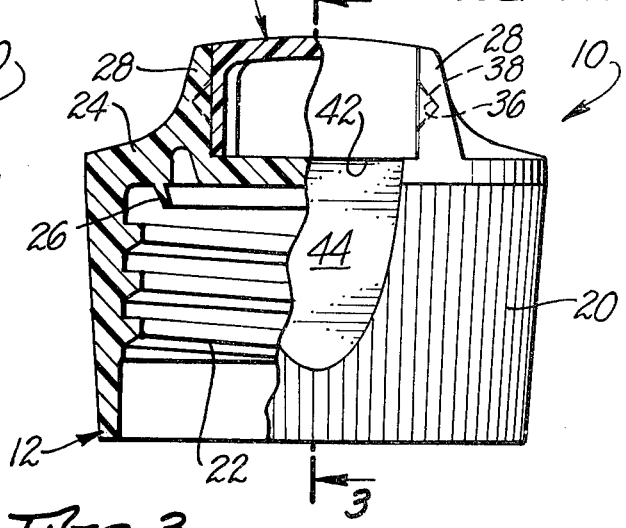
FIG. 2 is a front elevational view at an enlarged scale in which part of the closure is shown in section.

The particular dispensing closure illustrated in the drawing is constructed so as to embody certain operative concepts or principles as are indicated in the appended claims. It is considered obvious that other somewhat differently appearing and somewhat differently constructed closures can be designed so as to utilize these same concepts or principles through the use or exercise of routine engineering skill.

DETAILED DESCRIPTION

In the drawing there is shown a "toggle" type dispensing closure 10 which is formed as an integral unit by known conventional injection molding techniques out of a polyolefin such as polypropylene and/or out of other related polymers which are related to polypropylene in the sense that they have similar and/or comparable physical properties. Any polymer used in constructing a closure should be somewhat flexible and somewhat resilient in order to achieve the mode of operation embodied in this particular closure 10.

Figure 3:
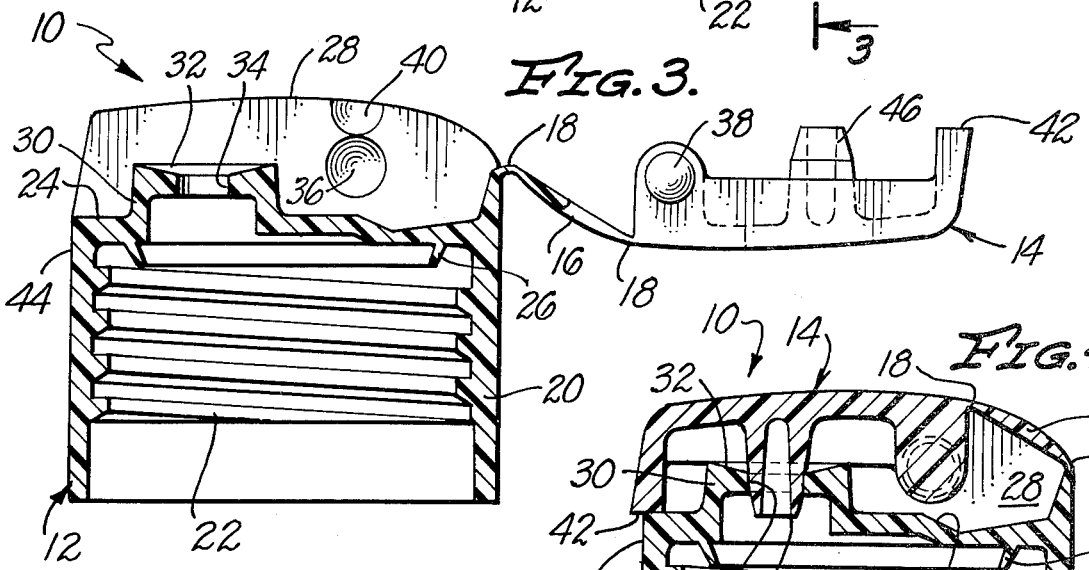
FIG. 3 corresponds to a cross-sectional view taken at line 3—3 of FIG. 2 in which the parts are shown as they are produced, prior to being placed in assembled or operative positions.

As the closure 10 is formed by such injection molding techniques the various parts of this closure 10 will be "unassembled" although attached to one another in the manner indicated in FIG. 3 of the drawing. As formed, the closure 10 will consist of a first part or cap 12 connected to a lid 14 through the use of a small, normally substantially flat, plate-like spring 16 and through the use of integral, flexible, line-like sections 18 located at the ends (not separately numbered) of the spring 16. These sections 18 serve as hinges or pivots during the use of the closure 10.

The cap 12 is formed so as to include a substantially cylindrical skirt 20 having internal threads 28 serving as a means for attaching the closure 10 to a container (not shown). Obviously various other known equivalent mounting means can be employed. This skirt 20 is covered by a top 24 carrying an internally extending, known type of sealing member 26 which is adapted to abut against a container (not shown) so as to form a seal therewith. Various other known equivalent sealing structures can be used instead of the sealing member 26. This top 24 is provided with upstanding opposed parallel walls 28 which are interconnected by the top 24 itself so as to create a structure which appears much as a flat bottomed groove (not separately numbered).

A small boss 30 is formed in the top 24 so as to extend upwardly generally between these two walls 28. This boss 30 is provided with a top wall 32 which in turn is provided with a centrally located dispensing opening 34. It is noted that this wall 32 is slightly tapered so as to facilitate any liquid (not shown) which may get upon it draining back into the opening 34.

Figure 6:
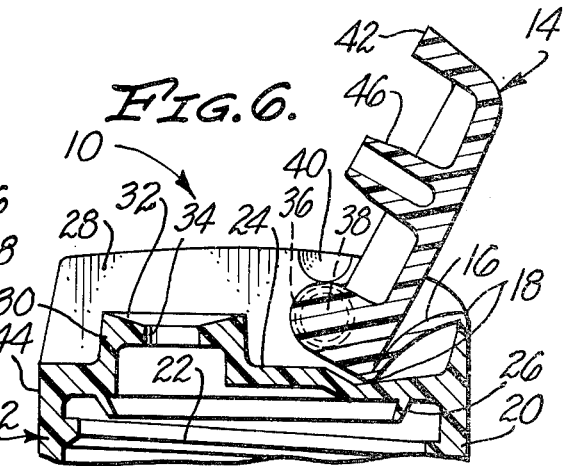

The walls 28 are provided with bearing openings 36 which are adapted to retain trunnions 38 on the lid 14 so as to rotatably mount this lid 14 on the cap 12 in such a manner that it can be rotated between a closed position as indicated in FIG. 6. It is presently considered preferable to use trunnions 38 which are substantially of a conical configuration and bearing openings 36 of a similar configuration but having an included angle which is greater than the included angle employed in connection with the trunnion 38. This is intended to provide comparatively low frictional characteristics so as to facilitate rotation of the lid 14 relative to the cap 12.

In order to facilitate assembly of the trunnions 38 within the bearing openings 36 it is preferred to locate tapered notches 40 in the walls 28 above the bearing openings 36 which will facilitate these walls 28 being temporarily deformed so as to move apart as the trunnions 38 are pressed downwardly into the notches 40 so as to "snap" or "pop" the trunnions 38 into place within the bearing openings 36. If desired various other snap-in or pop-in type bearings and trunnions can be utilized on the lid 14 and the cap 12 so as to rotatably mount the lid 14 upon the cap 12.

It is to be noted that the bearing openings 36 are located so that the axis of rotation of the lid 14 is parallel to both of the sections 18. It is also noted that these sections 18 are of a length which is slightly shorter than the distance between the walls 28 and the lid 14, and the spring 16 is of such a width that when the trunnions 38 are in place within the openings 36 that this lid 14 and the spring 16 fit between the walls 28. With this type of construction the closure 10 can be assembled from an as molded unassembled configuration as indicated in FIG. 3 by merely folding the lid 14 and the spring 16 about the sections 18 to a position in which the trunnions 38 are adjacent to the notches 40 and then pushing down on the lid 14 so as to snap or pop these trunnions 38 in place in the openings 36. During such assembly the sections 18 and the spring 16 fold so as to act as guides or locating means facilitating the lid 14 being located with the trunnions 38 generally at and within the notches 40.

When they are shaped and constructed in a preferred manner the sections 18 and the spring 16 appear essentially as a smooth exterior connecting the walls 28 in this assembled condition. Further, when assembled and closed the lid 14 preferably appears essentially as a top wall (not separately numbered) connecting the walls 28. In this assembled configuration when the lid 14 is closed it is located between these walls 28 in such a position that the only practical way of gaining access to the lid 14 so as to rotate it from a closed position is through engagement of a lip 42 on this lid 14 which is located generally above a notch-like depression 44 in the skirt 20. In the closed position of the lid 14 a bottle cork-like hollow sealing plug 46 fits into the opening 34 so as to engage the interior of this opening 34 so as to form a seal therewith.

Figure 5:
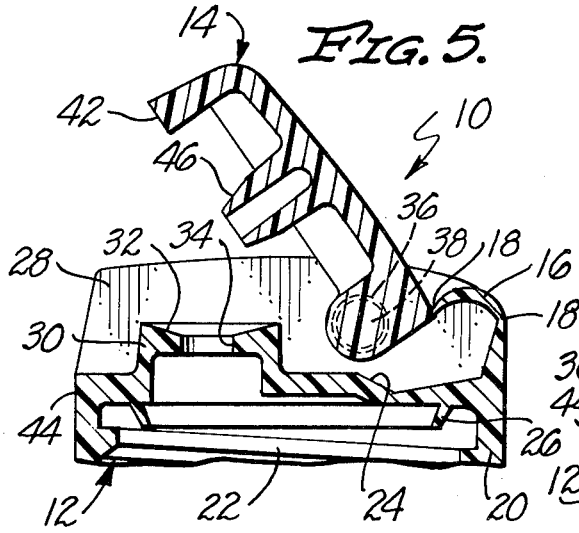

Once the closure 10 has been assembled in the manner indicated the utilization of this closure 10 is essentially rather simple. The lip 42 may be engaged so as to rotate the lid 14 through an intermediate position as indicated in FIG. 5 to the open position as indicated in FIG. 6. As this happens because of the manner in which the sections 18 are located they will be moved generally toward one another and will act as pivots or flexible connections so as to accommodate compressive forces being applied through them to the spring 16. Such forces will cause the spring 16 to be placed under compression and as a consequence of this the spring 16 will tend to bow generally in the manner indicated in FIG. 5 so as to exercise a force relative to the lid 14.

Figure 4:
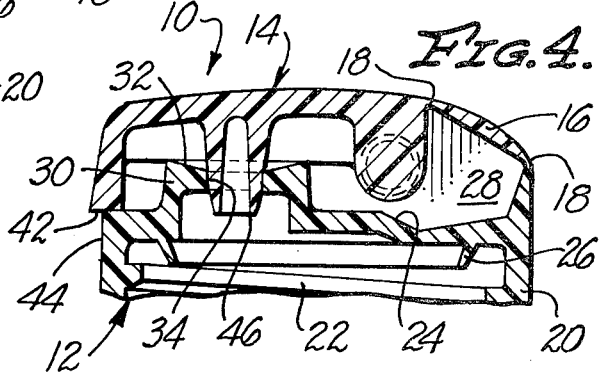
FIGS. 4, 5 and 6 are partial cross-sectional views corresponding to FIG. 3 showing various positions of a lid as employed in the closure illustrated in the preceding figures and of a spring associated with this lid.

As the lid 14 is moved between open and closed positions as indicated in FIGS. 4 and 6, it will pass through what may be referred to as an overcenter position when it is located relative to the cap 12 substantially as indicated in FIG. 5. If the lid 14 is released when it is between open and closed positions as noted, the spring 16 will act so as to tend to pivot this lid 14 toward whichever of these two positions is most closely adjacent to the position of the lid 14 as it is released. Thus, the action of the spring 16 will, when the lid 14 is disengaged when it is relatively adjacent to its closed position, tend to snap the lid toward the closed position in which the opening 34 is sealed off by the plug 46. Similarly when the lid 14 is released as it is closer to the open position than the closed position the spring 16 will tend to pivot the lid 14 to this open position.

Preferably the section 18 which is connected to the lid 14 will abut the top 24 as shown in FIG. 6 so as to act as a stop for the lid 14 when the lid 14 is in the open position and the spring 16 will generally hold the lid so that it abuts against the top 24 in this open position in such a manner that the lid 14 must be deliberately engaged and moved in order to be moved from the open position. If desired other mechanically equivalent abutting stops or stop means on the lid 14 and on the cap 12 can be employed to prevent the lid 14 from rotating past the open position shown in FIG. 6.

Within the closure 10 the lid 14 and the cap 12 are constructed so that the distance between the sections 18 is approximately equal when the lid 14 is in its open position and when the lid 14 is in its closed position. Further, the spring 16 is preferably of such a length between the sections 18 that it is not held under any significant compression or tension when the lid 14 is in either the open or the closed position. As a consequence of this the spring is unstressed except when the lid 14 is in the process of being moved between these two positions. This has the result that the spring 16 will not take a "permanent set" as a result of being subject to a pressure or force throughout a prolonged period. It is considered that this is quite important in enabling the spring 16 to retain its resilient characteristics throughout the useful life of the closure 10.

This closure 10 is considered to be desirable in that it is a relatively simple, inexpensive structure capable of being easily molded and assembled at a comparatively nominal cost. In essence, the spring 16 and the sections 18 act as guides so as to facilitate the lid 14 being moved to a proper location for easy assembly. The closure 10 is also considered desirable in that all of the parts of the closure are substantially within the confines of the cap 12 when the lid 14 is in a closed position. This is considered to minimize the possibility of damage during handling and capping operations.

Further, when the lid 14 is in an open position the spring 16 and the sections 18 are located generally between the walls 28 so that they do not extend from the remainder of the closure. This is considered beneficial from an aesthetic standpoint and because it tends to minimize any possibility of damage to these parts when the lid 14 is open. Further the closure 10 is considered quite desirable in that this closure is believed to utilize a comparatively minimum number of parts such as hinges or flexible sections.

I claim:

1. A dispensing closure including a first closure part having an opening extending therethrough, a second closure part pivotally mounted on said first closure part so as to be capable of being rotated about a pivot axis between a closed position in which said second closure part closes off said opening so that material cannot pass therethrough and an open position in which said opening is exposed so as to permit material to pass therethrough and spring means connecting said first and second closure parts for holding said second closure part in either of said positions in which the improvement comprises:

said spring means comprising a spring having ends, one of which ends is pivotally connected to said first closure part and the other of which ends is pivotally connected to said second closure part, said first closure part having an upwardly opening cavity, the bottom of which is located below said pivot axis, said cavity having an upstanding wall, said one of said ends of said spring means being connected to said wall above said bottom of said cavity, said spring being connected to said second closure part at a location which is spaced so as to permit said other end of said spring which is connected to said second closure part to be pivoted toward said first closure part as said second closure part is pivoted from said closed to said open position, said cavity and said closure parts being dimensioned so as to accommodate movement of said second closure part and said other end of said spring into said cavity as said second closure part is pivoted between said positions and so that the distance between the ends of said spring is decreased so as to compress said spring as said second closure part is moved between said positions, said first and said second closure parts and said spring are integral with one another and are constructed of a polymer material having resilient, flexible physical properties.

2. A dispensing closure as claimed in claim 1 wherein:

said first and said second closure parts are shaped so that the distance between said ends is the same in both of said positions and said spring is of such a length that it is neither under compression nor tension in either of said positions.

3. A dispensing closure as claimed in claim 2 wherein:

said dispensing closure includes integral flexible sections pivotally connecting said ends of said spring to said first and said second closure parts.

4. A dispensing closure as claimed in claim 3 wherein:

said first and said second closure parts include cooperating bearing and trunnion means pivotally mounting said second closure part on said first closure part, said cooperating bearing and trunnion means being capable of being "snapped" into cooperating engagement with one another, and said spring connecting edges of said first and second closure parts which are separated from one another when said closure parts are unassembled.

5. A dispensing closure as claimed in claim 3 wherein:

said flexible sections are elongated, line-like sections extending parallel to the axis of rotation of said second closure part relative to said first closure part.

6. A dispensing closure as claimed in claim 3 wherein:

said spring in an uncompressed condition has a flat plate-like shape.

7. A dispensing closure as claimed in claim 1 wherein:

said first and said second closure parts include cooperating bearing and trunnion means pivotally mounting said second closure part on said first closure part, said cooperating bearing and trunnion means being capable of being "snapped" into cooperating engagement with one another, said spring connecting edges of said first and second closure parts which are separated from one another when said closure parts are unassembled, said flexible sections are elongated, line-like sections extending parallel to the axis of rotation of said section closure part relative to said first closure part, said spring in an uncompressed condition has a flat plate-like shape.

* * * * *

UNITED STATES PATENT AND TRADEMARK OFFICE

CERTIFICATE OF CORRECTION

PATENT NO. : 4,124,151

DATED : NOVEMBER 7, 1978

INVENTOR(S) : ROBERT E. HAZARD

It is certified that error appears in the above-identified patent and that said Letters Patent are hereby corrected as shown below:

Column 1, line 46, "strip" should read --strap--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,124,151

DATED : NOVEMBER 7, 1978

INVENTOR(S) : ROBERT E. HAZARD

It is certified that error appears in the above-identified patent and that said Letters Patent are hereby corrected as shown below:

Column 8, line 20 (Claim 7), "section" should read --second--.

Signed and Sealed this

*Eighteenth* Day of *December 1979*

[SEAL]

*Attest:*

SIDNEY A. DIAMOND

*Attesting Officer*

*Commissioner of Patents and Trademarks*